US006923331B2

(12) United States Patent
Sommerfeld

(10) Patent No.: US 6,923,331 B2
(45) Date of Patent: Aug. 2, 2005

(54) HIGH CAPACITY DRAFT GEAR

(75) Inventor: Howard Sommerfeld, Oak Forest, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/634,559

(22) Filed: Aug. 5, 2003

(65) Prior Publication Data

US 2005/0029214 A1 Feb. 10, 2005

(51) Int. Cl.[7] ..... B61G 9/00

(52) U.S. Cl. ..... 213/32 C; 213/43; 213/24; 213/35; 213/41

(58) Field of Search ..... 213/43, 22, 24, 213/31, 32 A, 32 R, 34, 35, 37, 38, 39, 40 R, 41, 44, 45, 32 C, 23

(56) References Cited

U.S. PATENT DOCUMENTS 3,368,698 A * 2/1968 Cardwell ..... 213/43

5,529,194 A * 6/1996 Merker et al. ..... 213/32 C

* cited by examiner

*Primary Examiner*—Mark T. Le
(74) *Attorney, Agent, or Firm*—James Ray & Assoc.

(57) ABSTRACT

A friction-type draft gear assembly includes a housing having an open front and closed rear portions. A compressible cushioning element is positioned within the rear portion with a seating arrangement abutting one end thereof adjacent the open front portion. A friction cushioning element is provided in the open front portion of the housing. A spring release mechanism is adapted for continuously urging the friction cushioning element outwardly from the compressible cushioning element thereby releasing such friction cushioning element after compression of such draft gear assembly. A compressible cushioning element includes a hydraulic cylinder having a slidable piston to define a high pressure chamber and a low pressure chamber. A metering pin disposed within the piston has aworking portion of a decreased diameter for increasing shock absorbing capacity of such draft gear assembly.

8 Claims, 3 Drawing Sheets

HIGH CAPACITY DRAFT GEAR

CROSS-REFERENCE TO RELATED APPLICATIONS

This application is related to the invention disclosed in U.S. Pat. No. 3,368,698 titled "Hydraulic Draft Gear with Constant Force Device" and to the invention disclosed in U.S. Pat. No. 5,152,409 titled "Draft Gear Assembly", both are owned by the assignee of the present invention. The teachings of U.S. Pat. Nos. 3,358,698 and 5,152,409 are incorporated into this document by reference thereto.

FIELD OF THE INVENTION

The present invention relates, in general, to friction-type draft gear assemblies for use in cushioning both buff and draft shocks normally encountered by railroad rolling stock during make-up and operation of a train consist on a track structure and, more particularly, this invention relates to a friction-type draft gear assembly utilizing a hydraulic compressible cushioning member offering a higher protection to the railroad car.

BACKGROUND OF THE INVENTION

Friction type draft gear assemblies are widely used in United States railroad industry to provide protection to a railroad car by absorbing shocks in both draft and buff conditions. These draft gear assemblies must meet various Association of American Railroads (AAR) requirements. In one aspect the draft gear must be capable of maintaining the minimum shock absorbing capacity during its service life required by AAR standard M-901-E to be at least 36,000 foot pounds. In the other aspect AAR mandates working action of such draft gear to be achieved without exceeding a 500,000 pound reaction pressure acting on the freight car sills in order to prevent upsetting the coupler shank. In yet another aspect, the draft gear must pass a drop hammer test meeting the endurance portion of the AAR standard M-901-G, which determines the shock absorbing capacity of the draft gear.

The commonly used draft gears, installed in alignment with a railroad car center, include a housing having a front and a rear portion. A compressible cushioning element is positioned within the rear portion of the housing. A friction cushioning element is adopted in the front portion of the housing. The draft gears further include a spring release mechanism for continuously urging the friction cushioning element outwardly from the compressible cushioning element thereby releasing such friction cushioning element after compression of such draft gear. The compressible cushioning element is typically either of an all spring configuration or of a spring and hydraulic assembly combination as taught in U.S. Pat. Nos. 3,358,698 and 5,152,409.

The draft gear employing a hydraulic assembly, enables a higher drop hammer capacity than an all spring design, as evident by the hammer test results, and is capable of shock absorbing capacity of about 70,000 foot pounds.

In some applications which are not subject to existing AAR regulations and standards, a higher protection to the railroad car prior to the draft gear using all of its travel is required, even though this protection is achieved at a higher reaction force then is allowed by the existing AAR standards. This higher protection requires the shock absorbing capacity of the draft gear to be slightly higher than 100,000 foot pounds.

It is further desirable to achieve such higher protection, in the most economical method of retrofitting existing draft gears.

SUMMARY OF THE INVENTION

The present invention provides a draft gear assembly for railroad car stock having a higher shock absorbing capacity. The draft gear assembly comprises a housing closed at one end and open at the opposed end. The housing has a rear chamber adjacent the closed end and a front chamber adjacent the open end which is in open communication with said rear chamber. The housing has a pair of laterally spaced opposed friction surfaces located in the front chamber. A hydraulic compressible cushioning element is centrally disposed within the rear chamber with one end thereof abutting at least a portion of an inner surface of the closed end of the housing and extending longitudinally from such one end. The hydraulic compressible cushioning element comprises a spring and a hydraulic cylinder having a piston for establishing a low pressure chamber and a high pressure chamber. A flexible boot is fastened to the piston at one end and to the cylinder at the other end to prevent fluid leakage. A fluid communication means between the chambers and an orifices are provided within a head of the piston for equalizing and control of fluid pressure. A coil compression spring is disposed within an axial bore of the piston. A pin is disposed within a piston head cavity. A variable orifice metering having a stem element with a working end is disposed within the axial bore and is biased by the compression coil spring against the pin in its fully released position. A hydraulic compressible cushioning element positioning means is positioned adjacent such one end of the hydraulic compressible cushioning element and the inner surface of such closed end of the housing for maintaining such one end of the hydraulic compressible cushioning element centrally located in the rear chamber of the housing during compression and extension of such compressible cushioning element. A seat means with at least a portion of one surface thereof abutting the opposite end of the hydraulic compressible cushioning element is mounted to move longitudinally within the housing for respectively compressing and releasing the hydraulic compressible cushioning element during application and release of a force on the draft gear assembly. A friction cushioning means is positioned at least partially within the front chamber of the housing for absorbing energy during application of a force sufficient to cause a compression of the draft gear assembly. The friction cushioning means includes a pair of laterally spaced stationary outer plates which have an outer friction surface engaging the laterally spaced friction surfaces carried by the housing. The pair of stationary outer plates have a Brinell hardness of between about 429 and 495. The outer friction surface includes at least one recessed area to reduce the frictional surface engaging area between the stationary outer plate and the laterally spaced friction surface carried by the housing, and at the same time decrease relative movement between such stationary outer plate and the housing. A pair of laterally spaced movable plates having at least a portion of an outer friction surface movably and frictionally engaging an inner friction surface of the stationary outer plate and one edge engaging the seat means. A pair of laterally spaced tapered stationary plates have an outer friction surface movably and frictionally engaging at least a portion of an inner friction surface of the movable plate. A pair of laterally spaced wedge shoes having at least a portion of an outer friction surface movably and frictionally engaging at least a portion of an inner friction surface of the tapered stationary plate and at least a portion of one edge engaging the seat means. The pair of wedge shoes have a predetermined tapered portion on at least a portion of an opposed edge thereof. A center wedge having a pair of matching predetermined tapered portions for engaging the tapered portion of the wedge shoe to initiate frictional engagement of the friction cushioning means and thereby absorb energy. A spring release means engaging and longitudinally extending between the seat means and the center wedge for continuously urging the friction cushioning means outwardly from the compressible cushioning means to release such friction cushioning element when an applied force compressing the draft gear is removed. Also included is a shock absorbing capacity increasing means disposed within the piston containing, in a preferred embodiment, an insert disposed within the axial cylinder guide in combination with a reduced diameter of the working end of the variable orifice metering pin.

OBJECTS OF THE INVENTION

It is, therefore, one of the primary objects of the present invention to provide a draft gear assembly which protects a railroad car by absorbing shocks in both draft and buff conditions.

A further object of the present invention is to provide a draft gear assembly having a higher shock absorbing capacity which exceeds existing AAR standards.

Another object of the present invention is to provide economical means of retrofitting existing draft gear to achieve a higher shock absorbing capacity.

These and various other objects and advantages to the present invention will become more readily apparent to those persons skilled in the relevant art from the following more detailed description of the invention, particularly, when such description is taken in conjunction with the attached drawings and the appended claims.

DESCRIPTION OF THE PREFERRED AND ALTERNATIVE EMBODIMENTS

Figure 1:
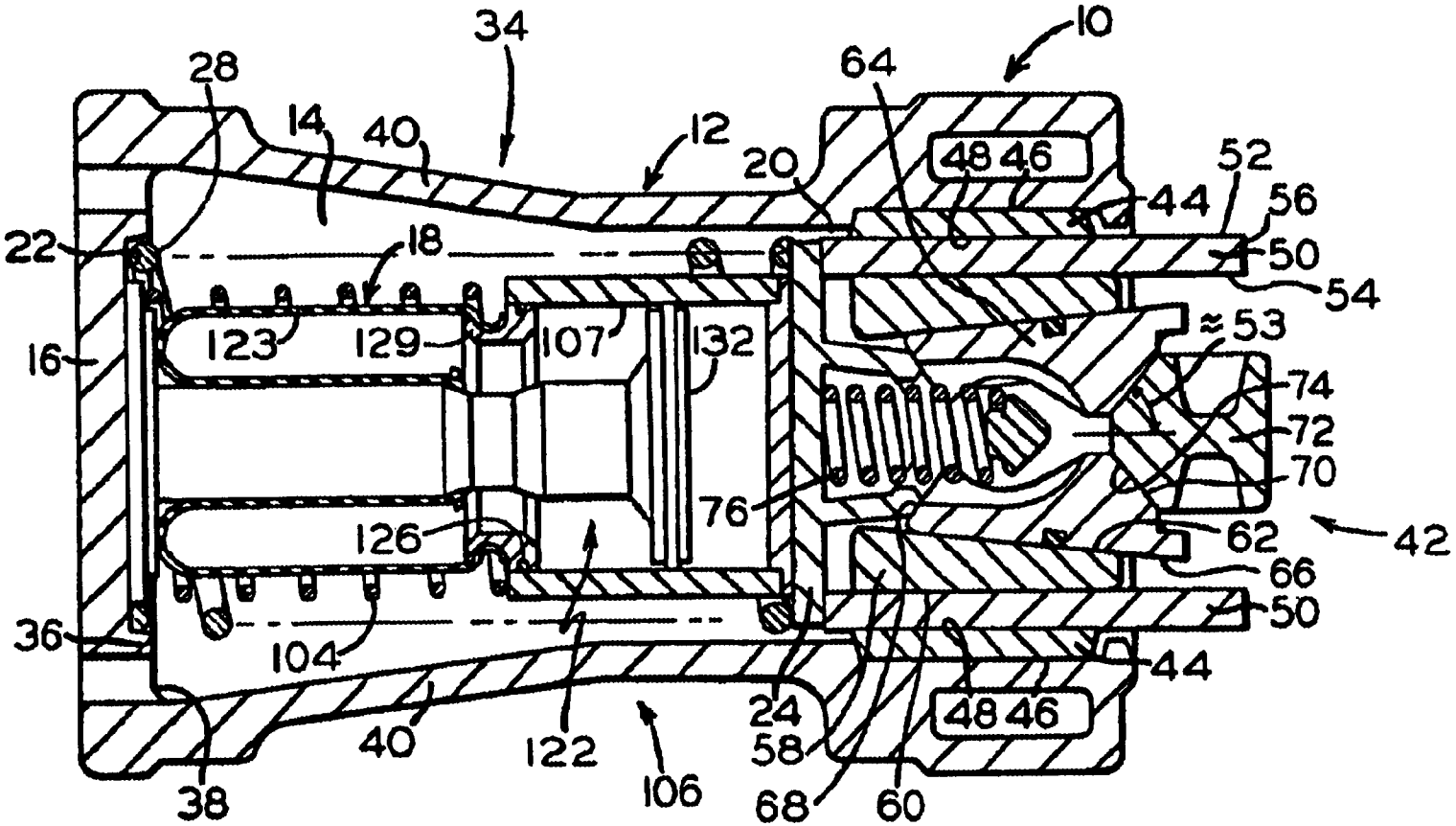
FIG. 1 is a longitudinal cross-sectional view of a draft gear of the present invention.

Prior to proceeding to the more detailed description of the present invention, it should be noted that for the sake of clarity identical components, having identical functions have been identified with identical reference numerals throughout the several views, which have been illustrated in the drawing figures.

The present invention enables a higher shock absorbing capacity of the existing draft gear assembly containing a hydraulic assembly by employing a means which increases the resistive pressure on the low pressure side of the hydraulic cylinder thus requiring an increased pressure on the high pressure side of the cylinder and, more importantly, enabling a higher shock absorbing capacity of the draft gear assembly.

Figure 2:
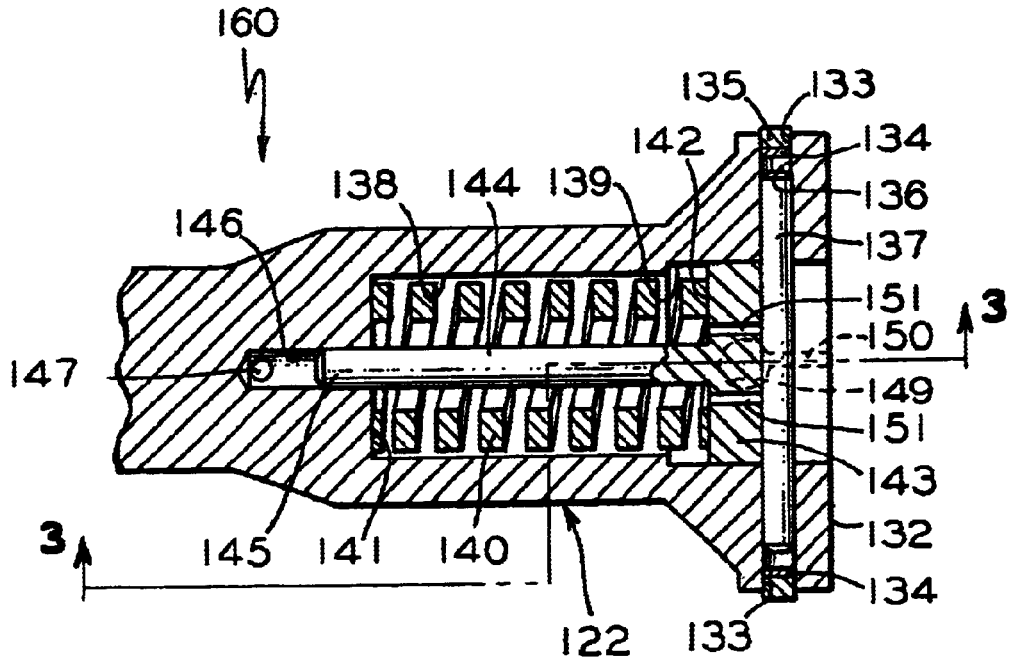
FIG. 2 is a partial axial cross-sectional view, particularly showing the piston of the hydraulic cushioning member.
Figure 3:
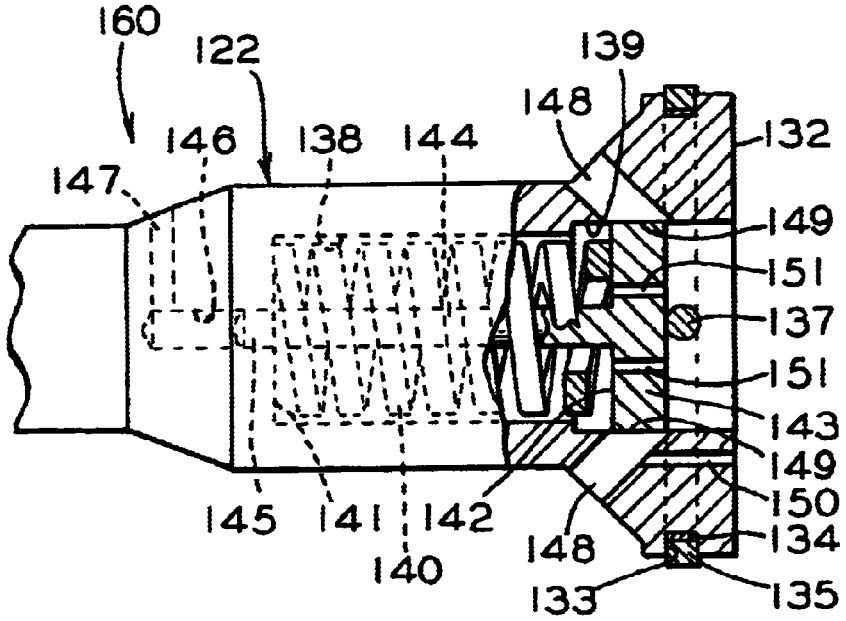
FIG. 3 is a partial axial cross-sectional view of the piston along the lines 3—3 in FIG. 2.

Referring to the present invention, as shown in FIGS. 1–3, the draft gear assembly is generally designated 10. The draft gear assembly 10 includes a housing, generally designated 12, open at one end and having a rear portion 14 adjacent a bottom wall 16 which closes the other end of housing 12. Rear portion 14 is adapted for receiving therein a compressible cushioning means, generally designated 18. A front portion 20 of the housing 12 is maintained in open communication with the rear portion 14.

The compressible cushioning element 18 is centrally disposed within the rear portion 14 and has one end thereof abutting at least a portion of an inner surface 22 of the bottom wall 16 of housing 12. The compressible cushioning element 18 includes at least one cushioning spring 28 and a hydraulic assembly, generally designated 34, which includes at least one cylinder spring 104 and a hydraulic cylinder, generally designated 106. The at least one cylinder spring 104 extending longitudinally from the bottom wall 16 is disposed intermediate such inner surface 22 and the hydraulic cylinder 106. A seat means 24 abutting a cylinder housing 107 of the hydraulic cylinder 106 is adopted within the housing 12 for longitudinal movement therein for respectively compressing and releasing the compressible cushioning element 18 during application and release of a force on the draft gear assembly 10. The seat means 24 further abutting one end of the at least one cushioning spring 28 which has a second end abutting the bottom wall 16 of the rear portion 14.

A piston, generally designated 122, adapted with a head 132 is mounted within the cylinder housing 107 for reciprocal motion thereof. A flexible boot 123 having one end fastened to the piston 122 and having a second end fastened to a cap and boot adapter 126 of the cylinder 106. A rubber gasket 129 mounted within cap and boot adapter 126 seals the space between such adapter 126 and the cylinder 106 to prevent leakage.

An expansion ring 134 and a piston ring 135 are mounted within an annular groove 133 formed within the piston head 132. A first cavity 136 coplanar with the groove 133 is adapted in the piston head 132 for receiving a pin 137 extending through the piston head 132 with ends adjacent the expansion ring 134.

A compression coil spring 140 of a first predetermined spring rate is disposed within an axial bore 138, which has a first predetermined diameter, of the piston 122 and further disposed within an axial counterbore 139 abutting such axial bore 138. One end of the compression coil spring 140 abuts a rear wall 141 of the bore 138 and the other end of the compression coil spring 140 abuts an inner surface 142 of the variable orifice metering pin 143 which is slideably disposed within such counterbore 139.

The variable orifice metering pin 143 is biased by such compression coil spring 140 against the pin 137. A stem element 144 attached to the inner surface 142 has a working end 145 of a predetermined length, typically no greater than 1 inch, and a third predetermined diameter, typically between 0.278 inches and 0.279 inches, is adapted for sliding in an axial cylinder guide 146 of a second predetermined diameter, which is axially concentric with such axial bore 138 at such rear wall 141 thereof. A second cavity 147 bored perpendicular to such axial cylinder guide 146 connects the axial cylinder guide 146 with the outside of the piston 122 for relieving the pressure in the cylinder guide 146.

The piston head 132 is adapted with at least one fluid passage 148 bored obliquely through the side walls of the piston for connecting the high pressure side of the cylinder 106 with the low pressure side of the cylinder 106 and piston 122. Preferably, such at least one passage is a pair of fluid passages 148 spaced diametrically opposite each other. Fluid passages 148 include orifices 149 abutting such counter bore 139 and aligned to be almost, but not quite, completely closed when such variable orifice metering pin 143 is in its outermost or released position, as best shown in FIG. 2. The orifices 149 are slightly open to enable quick return of the variable orifice metering pin 143 to its full released position and further enable a release of any residual pressure on piston 122. A restricted bore 150 is adapted from the face of the piston 132 to one of the passages 148 for insuring a rapid return of the variable orifice metering pin 143 to its full release position. At least one aperture 151 is provided in the variable orifice metering pin 143 for equalizing the pressure on both sides of the piston 122. In the presently preferred embodiment such at least one aperture 151 is three apertures 151 equally spaced about the longitudinal axis of such variable orifice metering pin 143.

The housing 12 further includes a compressible cushioning element 18 positioning means 36 disposed adjacent the inner surface 22 of the bottom wall 16 for maintaining that end of the compressible cushioning element 18 centrally located within the rear portion 14 of the housing 12 during compression and extension of such compressible cushioning element 18. The positioning means 36 includes a portion 38 of a predetermined thickness disposed in the housing 12 along two opposed sides adjacent the inner surface 22 of the bottom wall 16 and an inner surface of a connecting sidewall 40 of the housing 12. The positioning means 36 is preferably integral to the bottom wall 16.

A friction cushioning means, generally designated as 42, is disposed at least partially within the front portion 20 of the housing 12. The friction cushioning means 42 absorbs energy during application of a force sufficient to cause a compression of the draft gear assembly 10.

The friction cushioning means 42 includes a pair of laterally spaced outer stationary plates 44 having an inner friction surface 48 and an opposed outer surface 46 engaging the housing 12.

It is of critical importance for the objectives of the present invention to be met that the outer stationary plates have a Brinell hardness of between about 429 and 495 throughout. It was discovered that at a hardness of less than 429 the draft gear assembly 10 life was unacceptable, and at a hardness of more than 495 the draft gear assembly 10 would not meet the specifications.

A pair of laterally spaced movable plates 50 of substantially uniform thickness having an outer friction surface 52 and an inner friction surface 54 and at least one substantially flat edge 56 intermediate the outer friction surface 52 and the inner friction surface 54 is disposed within the open end of the draft gear assembly 10. The inner friction surface 54 having an edge 56 thereof engaging the seat means 24. At least a portion of the outer friction surface 52 movably and frictionally engages the inner friction surface 48 of the outer stationary plate 44.

A pair of laterally spaced tapered plates 58 having an outer friction surface 60 and an opposed inner friction surface 62 are disposed adjacent such movable plates 50. The outer friction surface 60 movably and frictionally engages at least a portion of the inner friction surface 54 of the movable plate 50.

The friction cushioning means 42 further includes a pair of laterally spaced wedge shoes 64 which have at least a portion of an outer friction surface 66 movably and frictionally engaging at least a portion of the inner friction surface 62 of the tapered stationary plate 58. Wedge shoes 64 have at least a portion of one edge 68 engaging seat means 24 and a predetermined tapered portion 70 on an opposed edge thereof.

A center wedge 72 having a pair of matching tapered portions 74 for engaging the tapered portion 70 of the wedge shoe 64 is provided to initiate frictional engagement of the friction cushioning means 42.

It has been discovered that the tapered portions 70 of the wedge shoes 64 and the tapered portions 74 of the center wedge 72 which are tapered upwardly and outwardly from a plane intersecting the longitudinal centerline of the draft gear assembly 10 must be controlled within a very close tolerance of about 53.0 degrees when such compressible cushioning element 18 includes the hydraulic assembly 34.

The draft gear assembly 10 additionally includes a spring release means 76 engaging and extending longitudinally between the seat means 24 and the center wedge 72 for continuously urging the friction cushioning means 42 outwardly from the compressible cushioning means 18 to release the friction cushioning means 42 when an applied force compressing the draft gear assembly 10 is removed.

In operation upon impact into a coupler (not shown) the buffing shock is transmitted from the coupler (not shown) through the front follower (not shown) to the central wedge 72, causing it to act through the wedge shoes 64 and thereby compress all of the cushioning elements simultaneously. These parts will furnish sufficient cushioning for light buffing shocks. After a suitable travel, however, the follower (not shown) will abut the outer ends of the movable plates 50 introducing energy-absorbing friction between the movable plates 50 and the stationary plates 58 and 44 which have been pressed together by the action of the wedge shoes 64. As this action continues, the pressure between the adjacent surfaces of the intercalated plates has been enormously increased due to the fact that the wedge shoes 64 are loaded against the cushioning mechanism 42. The energy absorption and dissipation through friction and compression of the cushioning mechanism continues until the gear is closed including compression of cushioning element 18.

Internal to compressible cushioning element 18, upon impact pressure is transmitted to the variable orifice metering pin 143. Hydraulic fluid flows into the bore 138 through the apertures 151, equalizing the pressure on both sides of the variable orifice metering pin 143. However, because of the difference in the area between the inner and outer faces of the variable orifice metering pin 143 due to the stem 144, the total force exerted on the outer face is greater than the total force exerted onto the inner face resulting in inward movement of the variable orifice metering pin 143 against the resistance of the compression coil spring 140 thereby exposing the orifices 149 and enabling the fluid to flow from the high pressure side of the cylinder 106 into the low pressure side of the cylinder 106 and piston 122.

As the velocity of the impact decreases and the draft gear 10 starts to release, the pressure in the hydraulic cylinder 106 decreases accordingly, causing the variable orifice metering pin 143 to move outwardly due to resistance of the spring 140 and close orifices 149.

It will be apparent that the diameter of the working end 145 of the stem element 144 and the rate of the compression coil spring 140 have a direct effect on the resistive pressure in the low pressure side of the cylinder 106 and, more importantly, on the increased shock absorbing capacity of the draft gear 10.

It has been discovered that decreasing diameter of the working end 145 of the stem element 144 to about 0.211 inches would increase the shock absorbing capacity to a desired requirement of slightly above 100,000 foot pounds. It has been further determined that decreasing the diameter of the end 145 of the stem element 144 to about 0.150 inches will further increase the shock absorbing capacity but will result in failure of such variable orifice metering pin 143. It has been additionally determined that decreasing the diameter of the overall stem element 144 beyond the working end 145, typically no greater than 1 inch in length, will not change the performance of the draft gear but will result in accelerated failures of such variable orifice metering pin 143.

It has been determined that employing a compression coil spring 140 of a second predetermined spring rate which is greater than said first predetermined spring rate would increase the shock absorbing capacity of the draft gear 10, but retrofit costs would be higher as compared with the costs to decrease the diameter of the working end 145.

It has been further determined that providing a predetermined clearance between said working end 145 and said axial cylinder guide 146 between 0.002 inches and 0.004 inches enables required sliding motion of the working end 145 within the axial cylinder guide 146.

Figure 4:
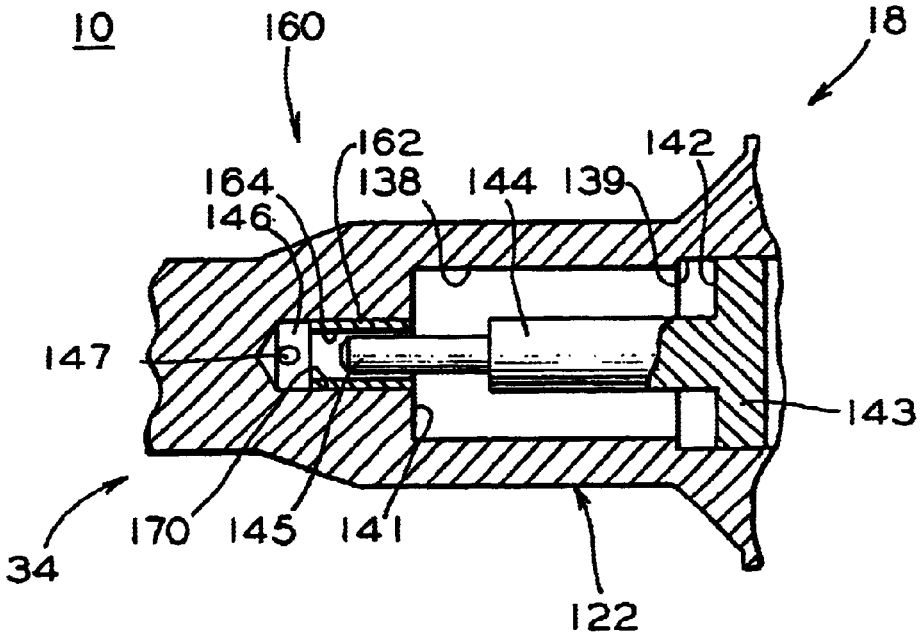
FIG. 4 is a partial axial cross-sectional view of the piston, particularly showing a presently preferred embodiment of a shock absorbing capacity increasing means.

A shock absorbing capacity increasing means, generally designated 160, disposed within piston 122 are provided for economical retrofitting of the existing draft gear assembly 10 to increase the pressure on the high side of the cylinder and to subsequently increase the reaction pressure of the draft gear assembly 10. In the presently preferred embodiment, such shock absorbing capacity increasing means 160 includes the variable orifice metering pin 143 having the forth predetermined diameter of the working end 145 of the stem portion 144 between 0.150 inches and 0.278 inches and preferably having a fifth predetermined diameter between 0.210 inches and 0.211 inches. Such shock absorbing capacity increasing means 160 further includes an insert 170, best shown in FIG. 4, disposed within the cylinder guide 146. Such insert 160 having an outer diameter 162 slightly larger than the second predetermined diameter of the cylinder guide 146 and further having an inner diameter 164 slightly larger than the forth predetermined diameter or the fifth predetermined diameter of the working end 145 of the stem element 144 to provide a predetermined clearance between the insert 160 and the working end 145 of between 0.002 to 0.004 inches.

Figure 5:
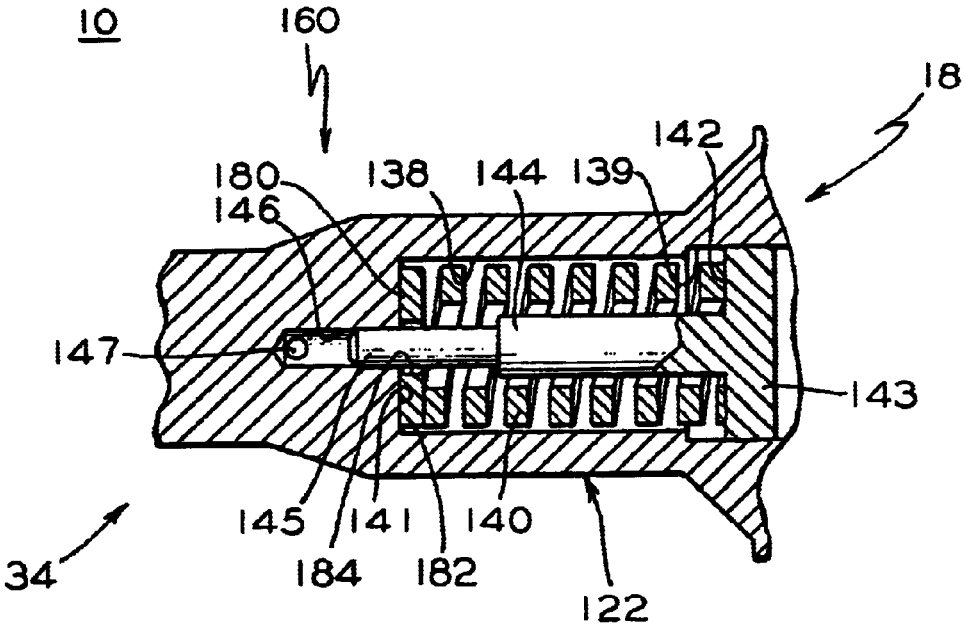
FIG. 5 is a partial axial cross-sectional view of the piston, particularly showing a first alternative embodiment of the shock absorbing capacity increasing means.

In a first alternative embodiment, such shock absorbing capacity increasing means 160 includes the variable orifice metering pin 143 having the forth predetermined diameter of the working end 145 of the stem portion 144 between 0.150 inches and 0.278 inches and preferably having a fifth predetermined diameter between 0.210 inches and 0.211 inches. Such shock absorbing capacity increasing means 160 of the first alternative embodiment further has a spacer 180, best shown in FIG. 5, disposed intermediate the rear wall 141 of the bore 138 and the compression coil spring 140. Such insert 180 having an outer diameter 182 slightly smaller than the first predetermined diameter of the axial bore 138 and further having an inner diameter 184 slightly larger than the forth predetermined diameter or the fifth predetermined diameter of the working end 145 of the stem element 144 to provide the clearance between insert 160 and the working end 145 of between 0.002 to 0.004 inches.

In a second alternative embodiment such shock absorbing capacity increasing means 160 includes the variable orifice metering pin 143 having working end 145 of the third predetermined diameter in combination with the compression coil spring 140 having a second predetermined spring rate.

In the third alternative embodiment such shock absorbing capacity increasing means 160 includes the variable orifice metering pin 143 having the forth predetermined diameter of the working end 145 of the stem portion 144 between 0.150 inches and 0.278 inches and preferably having a fifth predetermined diameter between 0.210 inches and 0.211 inches and further including the piston 122 having a cylinder guide 146 of a sixth predetermined diameter to provide the clearance between such cylinder guide 146 and the working end 145 of between 0.002 to 0.004 inches.

Although a presently preferred and various alternative embodiments of the present invention have been described in considerable detail above with particular reference to the drawing FIGURES, it should be understood that various additional modifications and/or adaptations of the present invention can be made and/or envisioned by those persons skilled in the relevant art without departing from either the spirit of the instant invention or the scope of the appended claims.

I claim:

1. A draft gear assembly for absorbing buff and draft shocks encountered in a railroad rolling stock, said draft gear assembly comprising:

(a) a housing having a closed end and an open end opposing said closed end, said housing further having a rear portion adjacent said closed end and a front portion adjacent said open end, said rear portion having a bottom wall, said front portion being in open communication with said rear portion;

(b) a compressible cushioning element centrally disposed within said rear portion with one end thereof abutting at least a portion of an inner surface of said closed end of said housing, said compressible cushioning element extending longitudinally from said one end, said compressible cushioning element including a hydraulic cylinder and at least one cylinder spring caged between at least a portion of said cylinder and said bottom wall, said hydraulic cylinder including:

(i) a cylinder housing, (ii) a piston including a piston head, said piston having an axial bore of a first predetermined diameter having a rear wall and an open end, an axial counter bore abutting said axial bore at said open end, an axial cylinder guide concentric with said axial bore, said axial cylinder guide abutting said axial bore at said rear wall end, said axial cylinder guide having a second cavity bored substantially perpendicular to said cylinder guide for connecting it with an outside of said piston, said second cavity for further relieving a pressure in said axial cylinder guide, said piston slidably disposed within said cylinder housing to establish a high pressure chamber and a low pressure chamber, (iii) a flexible boot having one end fastened to said piston and having a second end fastened to a cap and boot adapter of said cylinder, (iv) a rubber gasket mounted within said cap and boot adapter for sealing a space between said cap and boot adapter and said cylinder to prevent leakage, (v) at least one fluid passage disposed within said piston for establishing a communication between said high pressure chamber and said low pressure chamber; said at least one fluid passage having flow restricting orifices disposed at one end adjacent said axial counter bore of said piston, said flow restricting orifices exposed to said high pressure chamber, (vi) an expansion ring and a piston ring mounted within an annular groove formed within said piston head, (vii) a first cavity coplanar with said annular groove of said piston head, (viii) a pin disposed within said first cavity, said pin extending through said piston head, said pin having ends adjacent said expansion ring, (ix) a variable orifice metering pin slideably disposed within said piston, said variable orifice metering pin having an inner surface and an outer surface, a stem element attached to said inner surface, said stem element having a first portion working end of a predetermined length and of a predetermined diameter which is between 0.150 inches and 0.278 inches, said stem element slidable within said axial cylinder guide, at least one aperture disposed within said variable orifice metering pin for equalizing a fluid pressure between said high pressure chamber and said low pressure chamber of said piston, said variable orifice metering pin at least partially closing said flow restricting orifices with said variable orifice metering pin being in its full released position, (x) a restricted bore extending from a surface of said piston head to said at least one fluid passage for insuring a rapid return of said variable orifice metering pin to its full release position, (xi) a compression coil spring of a first predetermined spring rate disposed within said axial bore of said piston having one end abutting said rear wall of said axial bore and having the other end abutting said inner surface of said variable orifice metering pin, said compression coil spring biasing said variable orifice metering pin against said pin disposed within said first cavity, and (xii) a shock absorbing capacity increasing means disposed within said piston and having said axial cylinder guide of a predetermined diameter for providing a predetermined clearance between said axial cylinder guide and said working end which is between 0.002 inches and 0.004 inches, said shock absorbing capacity increasing means for increasing a reaction fluid pressure in said low pressure chamber of said hydraulic cylinder, said shock absorbing capacity increasing means for further increasing a shock absorbing capacity of said draft gear assembly;

(c) a positioning means on said inner surface of said closed end of said housing for maintaining said one end of said hydraulic compressible cushioning element centrally positioned in said rear portion of said housing during compression and extension of said hydraulic compressible cushioning element;

(d) a seat means having at least a portion of one surface thereof abutting the opposite end of said hydraulic compressible cushioning element and mounted to move longitudinally within said housing for respectively compressing and releasing said hydraulic compressible cushioning element during application and release of a force on said draft gear assembly;

(e) a friction cushioning means positioned at least partially within said front portion of said housing for absorbing energy during a compression of said draft gear assembly, said friction cushioning means including:

(i) a pair of laterally spaced outer stationary plates having an outer surface and an opposed inner friction surface, said outer surface engaging said housing, said pair of outer stationary plates having Brinell hardness of between about 429 and 495 throughout, (ii) a pair of laterally spaced movable plates of substantially uniform thickness and having an outer friction surface and an inner friction surface and at least one substantially flat edge intermediate said outer friction and inner friction surfaces, said one edge engaging said seat means, at least a portion of said outer friction surface movably and frictionally engaging said inner friction surface of said outer stationary plate, (iii) a pair of laterally spaced tapered plates having an outer friction and an inner friction surface, said outer friction surface movably and frictionally engaging at least a portion of said inner friction surface of said movable plate, (iv) a pair of laterally spaced wedge shoes having at least a portion of an outer friction surface movably and frictionally engaging at least a portion of an inner friction surface of said tapered plate, and at least a portion of one edge engaging said seat means, said pair of wedge shoes having a predetermined tapered portion which is tapered upwardly and outwardly from a plane intersecting a longitudinal center line of said draft gear assembly at an angle of about 53 degrees on an opposed edge thereof, and (v) a center wedge having a pair of matching predetermined tapered portions at an angle of about 53 degrees for engaging said tapered portion of said wedge shoe to initiate frictional engagement of said friction cushioning means and thereby absorb energy; and (f) a spring release means engaging and longitudinally extending between said seat means and said center wedge for continuously urging said friction cushioning means outwardly from said compressible cushioning means to release said friction cushioning element when an applied force compressing said draft gear is removed.

2. A draft gear assembly, according to claim 1, wherein said draft gear assembly further includes at least one cushioning spring encasing said hydraulic compressible cushioning element, said at least one cushioning spring abutting said bottom wall of said rear portion at one end, said at least one cushioning spring abutting said seat means at a distal end.

3. A draft gear assembly, according to claim 1, wherein said housing further includes a built-up portion along two opposed sides adjacent said inner surface of said closed end and an inner surface of a connecting sidewall of said housing.

4. A draft gear assembly, according to claim 1, wherein said at least one passage is a pair of fluid passages spaced diametrically opposite each other.

5. A draft gear assembly, according to claim 1, wherein said at least one aperture is three apertures equally spaced about a longitudinal axis of said variable orifice metering pin.

6. A draft gear assembly, according to claim 1, wherein said working end of said stem element of said variable orifice metering pin having a predetermined diameter between 0.210 inches and 0.211 inches and said axial cylinder guide providing said predetermined clearance with said working end of between 0.002 inches and 0.004 inches.

7. A draft gear assembly for absorbing buff and draft shocks encountered in a railroad rolling stock, said draft gear assembly comprising:

(a) a housing having a closed end and an open end opposing said closed end, said housing further having a rear portion adjacent said closed end and a front portion adjacent said open end, said rear portion having a bottom wall, said front portion being in open communication with said rear portion;

(b) a compressible cushioning element centrally disposed within said rear portion with one end thereof abutting at least a portion of an inner surface of said closed end of said housing, said compressible cushioning element extending longitudinally from said one end, said compressible cushioning element including a hydraulic cylinder and at least one cylinder spring caged between at least a portion of said cylinder and said bottom wall, said hydraulic cylinder including:

(i) a cylinder housing, (ii) a piston including a piston head, said piston having an axial bore of a first predetermined diameter having a rear wall and an open end, an axial counter bore abutting said axial bore at said open end end, an axial cylinder guide concentric with said axial bore, said axial cylinder guide abutting said axial bore at; said rear wall end said axial cylinder guide having a second cavity bored substantially perpendicular to said cylinder guide for connecting thereof with an outside of said piston, said second cavity for further relieving a pressure in said axial cylinder guide, said piston slidably disposed within said cylinder housing to establish a high pressure chamber and a low pressure chamber, (iii) a flexible boot having one end fastened to said piston and having a second end fastened to a cap and boot adapter of said cylinder, (iv) a rubber gasket mounted within said cap and boot adapter for sealing a space between said cap and boot adapter and said cylinder to prevent leakage, (v) at least one fluid passage disposed within said piston for establishing a communication between said high pressure chamber and said low pressure chamber; said at least one fluid passage having flow restricting orifices disposed at one end adjacent said axial counter bore of said piston, said flow restricting orifices exposed to said high pressure chamber, (vi) an expansion ring and a piston ring mounted within an annular groove formed within said piston head, (vii) a first cavity coplanar with said annular groove of said piston head, (viii) a pin disposed within said first cavity, said pin extending through said piston head, said pin having ends adjacent said expansion ring, (ix) a variable orifice metering pin slideably disposed within said piston, said variable orifice metering pin having an inner surface and an outer surface, a stem element attached to said inner surface, said stem element having a first portion abutting said inner surface and extending axially therefrom, said first portion having a predetermined diameter which is between 0.278 inches and 0.279 inches and a working a working end axially disposed adjacent said first portion, said working end has a predetermined length and a predetermined diameter which is between 0.150 inches and 0.278 inches, said working end slidable within said axial cylinder guide, at least one aperture disposed within said variable orifice metering pin for equalizing a fluid pressure between said high pressure chamber and said low pressure chamber of said piston, said variable orifice metering pin at least partially closing said flow restricting orifices with said variable orifice metering pin being in its full released position, (x) a restricted bore extending from a surface of said piston head to said at least one fluid passage for insuring a rapid return of said variable orifice metering pin to its full release position, (xi) a compression coil spring of a first predetermined spring rate disposed within said axial bore of said piston having one end abutting said rear wall of said axial bore and having the other end abutting said inner surface of said variable orifice metering pin, said compression coil spring biasing said variable orifice metering pin against said pin disposed within said first cavity, and (xii) a shock absorbing capacity increasing means disposed within said piston and having said axial cylinder guide of a predetermined diameter for providing a predetermined clearance with said working end of said stem element, said predetermined clearance is between 0.002 inches and 0.004 inches, said shock absorbing capacity increasing means for increasing a reaction fluid pressure in said low pressure chamber of said hydraulic cylinder, said shock absorbing capacity increasing means for further increasing a shock absorbing capacity of said draft gear assembly;

(c) a positioning means on said inner surface of said closed end of said housing for maintaining said one end of said hydraulic compressible cushioning element centrally positioned in said rear portion of said housing during compression and extension of said hydraulic compressible cushioning element;

(d) a seat means having at least a portion of one surface thereof abutting the opposite end of said hydraulic compressible cushioning element and mounted to move longitudinally within said housing for respectively compressing and releasing said hydraulic compressible cushioning element during application and release of a force on said draft gear assembly;

(e) a friction cushioning means positioned at least partially within said front portion of said housing for absorbing energy during a compression of said draft gear assembly, said friction cushioning means including:

(i) a pair of laterally spaced outer stationary plates having an outer surface and an opposed inner friction surface, said outer surface engaging said housing, said pair of outer stationary plates having Brinell hardness of between about 429 and 495 throughout, (ii) a pair of laterally spaced movable plates of substantially uniform thickness and having an outer friction surface and an inner friction surface and at least one substantially flat edge intermediate said outer friction and inner friction surfaces, said one edge engaging said seat means, at least a portion of said outer friction surface movably and frictionally engaging said inner friction surface of said outer stationary plate, (iii) a pair of laterally spaced tapered plates having an outer friction and an inner friction surface, said outer friction surface movably and frictionally engaging at least a portion of said inner friction surface of said movable plate, (iv) a pair of laterally spaced wedge shoes having at least a portion of an outer friction surface movably and frictionally engaging at least a portion of an inner friction surface of said tapered plate, and at least a portion of one edge engaging said seat means, said pair of wedge shoes having a predetermined tapered portion which is tapered upwardly and outwardly from a plane intersecting a longitudinal center line of said draft gear assembly at an angle of about 53 degrees on an opposed edge thereof, and (v) a center wedge having a pair of matching predetermined tapered portions at an angle of about 53 degrees for engaging said tapered portion of said wedge shoe to initiate frictional engagement of said friction cushioning means and thereby absorb energy; and (f) a spring release means engaging and longitudinally extending between said seat means and said center wedge for continuously urging said friction cushioning means outwardly from said compressible cushioning means to release said friction cushioning element when an applied force compressing said draft gear is removed.

8. A draft gear assembly, according to claim 7, wherein said working end of said stem element of said variable orifice metering pin has a predetermined diameter between 0.210 inches and 0.211 inches and said axial cylinder guide provides said predetermined clearance with said working end of between 0.002 inches and 0.004 inches.

* * * * *